US006340268B1

(12) United States Patent
Alberson et al.

(10) Patent No.: US 6,340,268 B1
(45) Date of Patent: Jan. 22, 2002

(54) IMPACT ATTENUATING BARRIER WALL

(76) Inventors: Dean C. Alberson, 9191 Hensarling La., Bryan, TX (US) 77808; D. Lance Bullard, Jr., 21 Ranchero Rd., College Station, TX (US) 77845; John F. Carney, III, 15 Regent St., Worchester, MA (US) 01609

( * ) Notice: Subject to any disclaimer, the term of this patent is extended or adjusted under 35 U.S.C. 154(b) by 0 days.

(21) Appl. No.: 09/286,450

(22) Filed: Apr. 6, 1999

(51) Int. Cl.[7] ..... E01F 15/00
(52) U.S. Cl. ..... 404/6; 256/1
(58) Field of Search ..... 404/6, 9; 256/1, 256/13.1

(56) References Cited

U.S. PATENT DOCUMENTS

| | | | | | |
|---|---|---|---|---|---|
| 2,088,087 | A | * | 7/1937 | Hudson | 256/1 |
| 3,606,258 | A | * | 9/1971 | Fitch | 256/13.1 |
| 3,661,359 | A | * | 5/1972 | Walker | 256/1 |
| 3,845,936 | A | * | 11/1974 | Boedecker, Jr. et al. | 256/1 |
| 3,856,268 | A | * | 12/1974 | Fitch | 256/13.1 |
| 3,880,404 | A | * | 4/1975 | Figch | 256/1 |
| 3,951,384 | A | * | 4/1976 | Hildreth, Jr. | 256/1 |
| 4,022,134 | A | * | 5/1977 | Moore | 256/1 |
| 4,090,341 | A | * | 5/1978 | Vincent | 256/13.1 |
| 4,552,341 | A | * | 11/1985 | Zucker et al. | 256/1 |
| 4,645,375 | A | * | 2/1987 | Carney, III | 404/6 |
| 4,744,708 | A | * | 5/1988 | Cochrane | 256/1 |
| 4,785,577 | A | * | 11/1988 | Ledesbauer | 47/33 |
| 4,934,661 | A | * | 6/1990 | Denman et al. | 256/13.1 |
| 5,006,008 | A | * | 4/1991 | Bishop | 404/6 |
| 5,011,326 | A | * | 4/1991 | Carney, III | 404/6 |
| 5,238,228 | A | * | 8/1993 | Moon | 256/13.1 |
| 5,403,112 | A | * | 4/1995 | Carney, III | 404/6 |
| 5,480,255 | A | * | 1/1996 | Bernaquez et al. | 404/6 |
| 5,568,913 | A | * | 10/1996 | Nagler | 256/13.1 |
| 5,607,252 | A | * | 3/1997 | Tischer | 404/6 |
| 6,010,275 | A | * | 1/2000 | Fitch | 404/6 |

FOREIGN PATENT DOCUMENTS

| | | | | |
|---|---|---|---|---|
| FR | WO93/023626 | * | 11/1993 | 256/13.1 |
| SU | 1017759 | * | 5/1983 | 256/13.1 |
| SU | 1548314 | * | 3/1990 | 256/13.1 |
| SU | 1550024 | * | 3/1990 | 256/13.1 |

* cited by examiner

*Primary Examiner*—Thomas B. Will
*Assistant Examiner*—Kristine Markovich
(74) *Attorney, Agent, or Firm*—David A. Tamburro

(57) ABSTRACT

An impact attenuating barrier well extending longitudinally along a roadway and adapted to intercept an errant vehicle leaving the roadway and redirect the vehicle back onto the roadway. The wall comprises a fixed obstacle such as a concrete wall or a standard W-beam guardrail extending along the roadway. A plurality of first resilient energy absorbing HMW/HD polyethylene cylinders are arranged in side-by-side relationship between the obstacle and the roadway, the inner halves of adjacent cylinders defining gaps therebetween. A plurality of second resilient energy absorbing HMW/HD cylinders having a diameter smaller than the diameter of the first cylinders are located within the gaps to prevent snagging of an errant vehicle upon impact.

6 Claims, 2 Drawing Sheets

IMPACT ATTENUATING BARRIER WALL

BACKGROUND OF THE INVENTION

This invention relates generally to guardrail systems extending along a roadway, such as a conventional highway or a race track, for redirecting an errant vehicle back onto the roadway. It is especially directed to a novel, impact attenuating compressible barrier wall system capable of redirecting an errant vehicle back onto the roadway with minimal decelerating effect, minimal damage to the vehicle, and reduced risk of injury to the driver.

Roadways are often lined with protective barriers such as concrete walls and/or fixed guardrails including standard metal W-beams. When a car strikes against a concrete wall or an unyielding guardrail, even at a shallow angle the car can experience significant deceleration and damage and the driver can be seriously injured.

One prior effort to deal with these problems has been the placement of bundles of tires tied together and stacked in front of fixed obstacles such as the concrete barriers and unyielding guardrails. However, when hit at a shallow angle at high speeds, the tire walls can snag the car and violently reject it back into the stream of traffic, creating a dangerous situation for all drivers.

Another proposed places longitudinally extending vehicle interfacing rails adjacent the roadway and resilient energy absorbing cylinders between the rails and the fixed obstacles. Upon impact, the rails move with the car, absorbing energy and reducing damage to the car. This proposal works very well, preventing snagging and, after impact, restoring the rails substantially to their original operative position.

The invention described herein is considered to be an improvement over this latter proposal in that it eliminates the interfacing rails and relies only on a novel arrangement of resilient energy absorbing cylinders to absorb the energy of an impacting errant vehicle and to redirect the vehicle back onto the roadway.

SUMMARY OF THE INVENTION

Accordingly, the primary object of this invention is to provide an impact attenuating barrier wall extending along a roadway, the wall including a novel arrangement of resilient energy absorbing cylinders which, upon impact by an errant car, effectively intercept and redirect the car back onto the roadway with minimal damage to the car and reduced risk of injury to the driver.

The novel barrier wall of the invention achieves its objectives by providing a plurality of large diameter, compressible, resilient energy absorbing cylinders positioned in side-by-side relationship along the roadway between the roadway and an outer fixed protective barrier or obstacle such as a longitudinally extending concrete wall on a standard fixed guardrail. Gaps are formed between the inner halves of the side-by-side cylinders adjacent the roadway, and smaller diameter cylinders are placed in those gaps to substantially fill those gaps. Upon initial impact by an errant vehicle, the inner halves of the larger and smaller cylinders are compressed to form a substantially continuous vertical surface intercepting the vehicle, absorbing the energy of the vehicle and reducing damage to the vehicle. Placing the smaller cylinders in the gaps prevents snagging, and the cylinders effectively redirect the vehicle back into the roadway.

The cylinders are preferably constructed of a high molecular weight/high density (HMW/HD) polyethylene material of the type disclosed in U.S. Pat. No. 5,403,112, and possess the unique ability to first dissipate large amounts of energy upon impact by a vehicle, and then restore themselves to about 90 percent of their original shape, thereby substantially maintaining the integrity of the barrier wall through repeated impacts.

Other objects and advantages will become apparent from reading the following detailed description of the invention wherein reference is made to the accompanying drawings.

DETAILED DESCRIPTION OF THE INVENTION

Figure 1:
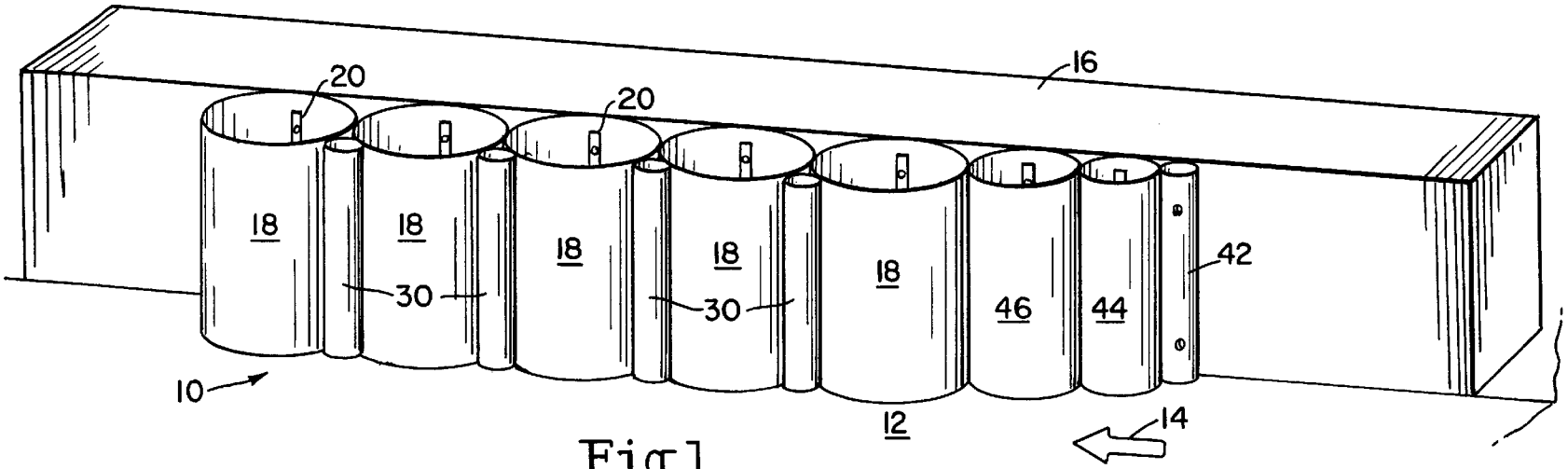
FIG. 1 is a front perspective view of the impact attenuating barrier wall of the invention.

Referring now to the drawings, the impact attenuating barrier wall 10 of the invention extends longitudinal along the side of a roadway 12 on which vehicles are traveling in the direction of arrow 14.

Barrier wall 10 includes a standard fixed protective barrier or obstacle such as a concrete wall 16 or a conventional W-beam guardrail system extending along the side of the roadway.

A plurality of large diameter compressible resilient energy absorbing cylinders 18 are arranged in side-by-side abutting relationship between roadway 12 and wall 16. Each of the cylinders is fastened to wall 16 by a bolt and strap assembly 20, and adjacent cylinders are fastened together by bolt and strap assemblies 22.

As mentioned above, cylinders 18 are of HMW/HD polyethylene material capable of absorbing substantial energy as they are compressed by an impacting errant vehicle and of redirecting the vehicle back onto the roadway 12. After impact, the cylinders slowly restore themselves substantially back to their original shape for continued use.

In a prototype of the invention, cylinders 18 were 36" diameter×48" high×1" wall thickness. The cylinders are sized to normally accommodate various sized vehicles of different mass and different CG's e.g. CG's within the range of about 12≧24 inches covering Formula 1 race cars to standard passenger vehicles.

Figure 3:
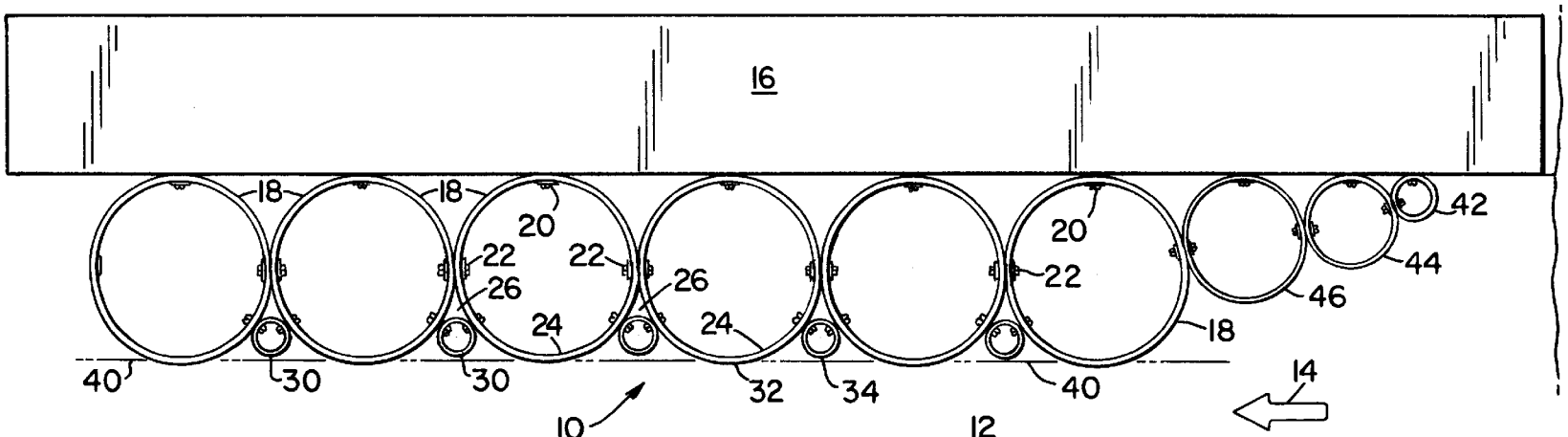
FIG. 3 is a top plan view of the invention.
Figure 2:
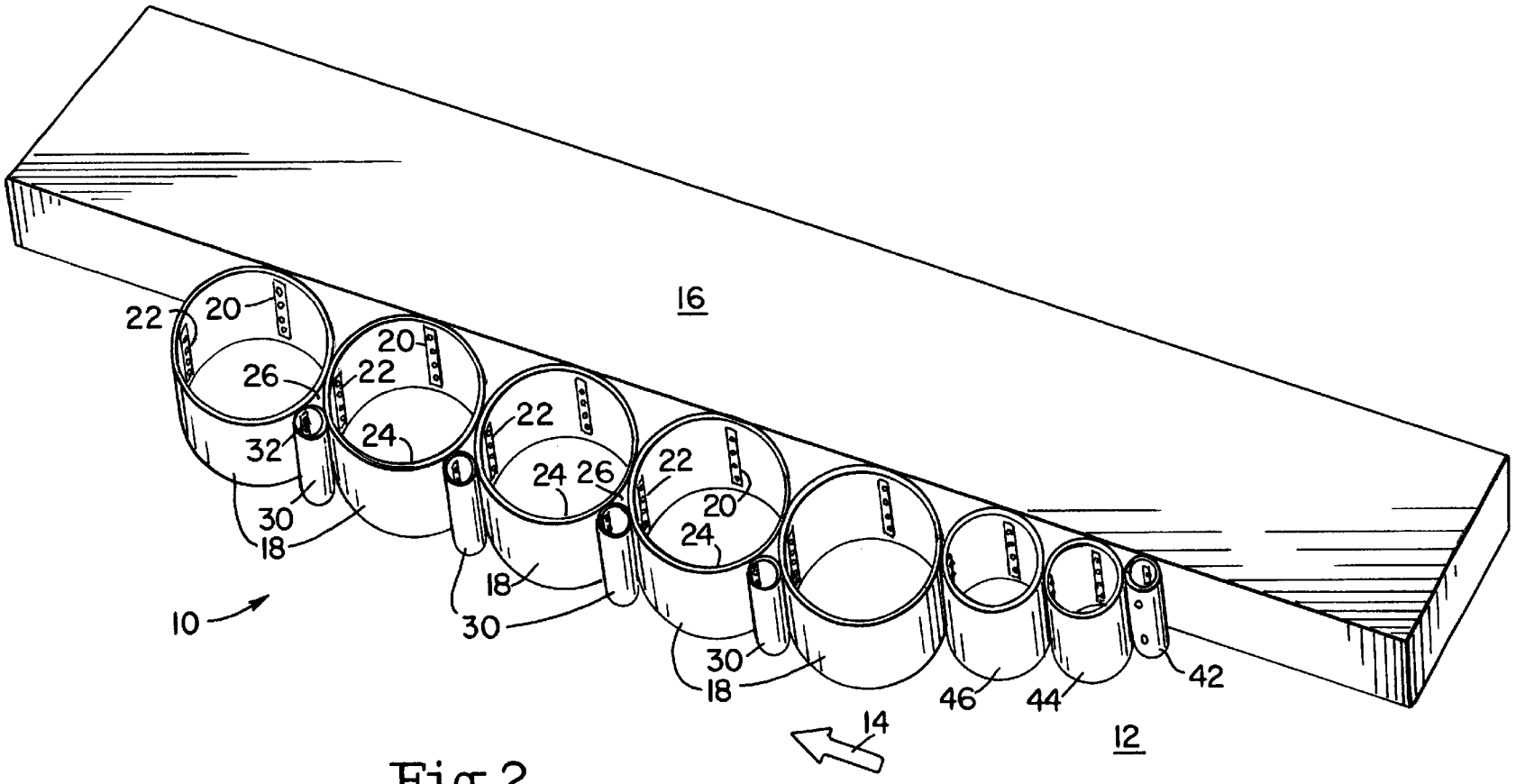
FIG. 2 is a top perspective view of the barrier wall of the invention.

As viewed in FIGS. 2 and 3, as the inner halves 24 of cylinders 18 diverge from bolt assemblies 22 away from each other toward roadway 12 a gap or space 26 is defined between the inner halves of adjacent cylinders adjacent roadway 12. Those gaps, if left exposed to roadway 12 and vehicles traveling thereon, may cause the inner halves 24 of cylinders 18 to snag an errant vehicle and perhaps violently reject it back into the stream of traffic on roadway 12, thus creating a dangerous situation for all drivers.

To alleviate that potential problem, a smaller diameter HMW/HD polyethylene cylinder (8" diameter×48" high×½" wall in the prototype) is positioned in each of gaps 26 and fastened against adjacent halves 24 by bolt/strap assemblies 32. As viewed in FIG. 3, cylinders 30 close the gaps 26, and the inner edges 32 and 34 of cylinders 18 and 30 lie in substantially the same vertical plane 40 extending along roadway 12.

When struck at a shallow angle by an errant vehicle, cylinders 18 and 30 collapse or flatten upon themselves and together form a slightly interrupted but substantially continuous vertical impact surface engaging the vehicle, absorbing the energy of the vehicle, and safely redirecting the vehicle back onto roadway with reduced damage to the vehicle. After impact, cylinders 18 and 30 slowly return substantially to their original shapes, thus restoring and maintaining the integrity of barrier wall 10 to its original condition for use in attenuating additional impacts.

As an additional safety measure, at the upstreams end of barrier wall 10 are a series of cylinders 42, 44, 46 increasing in diameter to the first cylinder 18 as a lead into the main wall section. In the prototype, cylinders 42, 44 and 46 were 8",18", and 24" diameter, respectively, all with ½" wall thickness. These cylinders avoid any abrupt head on impact at the upstream end.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. An impact attenuating barrier wall extending longitudinally along a roadway and adapted to intercept an errant vehicle leaving the roadway and redirect the vehicle back onto the roadway, said wall comprising fixed obstacle means extending along the roadway, a plurality of first resilient energy absorbing upright cylinders each having a substantially continuous outer cylindrical surface throughout its height, said cylinders arranged in side by side relationship between said obstacle means and said roadway and having inner halves facing said roadway, the inner halves of adjacent cylinders defining gaps therebetween, a plurality of second resilient energy absorbing upright cylinders each having a substantially continuous outer cylindrical surface throughout its height, said second cylinders having a diameter smaller than the diameter of said first cylinders and located within said gaps in connection with said first cylinders, said first and second cylinders having inner edges lying in substantially the same vertical plane extending along the roadway and providing a substantially continuous vertical impact surface along said roadway upon impact by an errant vehicle.

2. The impact attenuating barrier wall of claim 1, said first and second cylinders being of high molecular weight, high density polyethylene.

3. The impact attenuating barrier wall of claim 2, said first and second cylinders having a vertical height sufficient to intercept a vehicle having a center of gravity within the range of about 12–24 inches.

4. The impact attenuating barrier wall of claim 1, said first and second cylinders having a vertical height sufficient to intercept a vehicle having a center of gravity within the range of about 12–24 inches.

5. The impact attenuating barrier wall of claim 1, comprising first connecting means for connecting said first cylinders to said obstacle means, second connecting means for connecting said first cylinders to each other, and third connecting means for connecting said second cylinders to said first cylinders.

6. An impact attenuating barrier wall extending longitudinally along a roadway and adapted to intercept an errant vehicle leaving the roadway and redirect the vehicle back onto the roadway, said wall comprising fixed obstacle means extending along the roadway, a plurality of first resilient energy absorbing upright cylinders each having a substantially continuous outer cylindrical surface throughout its height, said cylinders arranged in side by side relationship between said obstacle means and said roadway and having inner halves facing said roadway, the inner halves of adjacent cylinders defining gaps therebetween, a plurality of second resilient energy absorbing upright cylinders each having a substantially continuous outer cylindrical surface throughout its height, said second cylinders having a diameter smaller than the diameter of said first cylinders and located within said gaps in connection with said first cylinders, said first and second cylinders being of high molecular weight, high density polyethylene, said first and second cylinders having inner edges which lie in substantially the same vertical plane extending along the roadway, the first and second cylinders providing a vertical impact surface along said roadway upon impact by an errant vehicle, said first and second cylinders having a vertical height sufficient to intercept a vehicle having a center of gravity within the range of about 12–24 inches, first connecting means for connecting said first cylinders to said obstacle means, second connecting means for connecting said first cylinders together, and third connecting means for connecting said second cylinders to said first cylinders.

* * * * *